US008448936B2

(12) United States Patent
Pan et al.

(10) Patent No.: US 8,448,936 B2
(45) Date of Patent: May 28, 2013

(54) AUTOMATIC DOCUMENT FEEDER WITH SHEET PICK-UP MODULE WITH SECOND ROTATION DIRECTION DELAYING TIME

(75) Inventors: Yung-Tai Pan, Taipei (TW); Chien-Kuo Kuan, Taipei (TW); Yi-Liang Chen, Taipei (TW); Ping-Hung Kuo, Taipei (TW)

(73) Assignee: Primax Electronics, Ltd., Taipei (TW)

( * ) Notice: Subject to any disclaimer, the term of this patent is extended or adjusted under 35 U.S.C. 154(b) by 426 days.

(21) Appl. No.: 12/753,236

(22) Filed: Apr. 2, 2010

(65) Prior Publication Data

US 2011/0156337 A1 Jun. 30, 2011

(30) Foreign Application Priority Data

Dec. 25, 2009 (TW) ..... 98144968 A

(51) Int. Cl.
*B65H 3/52* (2006.01)

(52) U.S. Cl.
CPC ..... *B65H 3/5261* (2013.01); *Y10S 271/902* (2013.01)
USPC ..... 271/122; 271/263; 271/902

(58) Field of Classification Search
USPC ..... 271/122, 117, 225, 902, 262, 263, 271/258.03
See application file for complete search history.

(56) References Cited

U.S. PATENT DOCUMENTS

| | | | | |
|---|---|---|---|---|
| 3,698,706 | A * | 10/1972 | Mihojevich et al. | 271/276 |
| 4,436,298 | A * | 3/1984 | Donner et al. | 271/122 |
| 5,029,837 | A * | 7/1991 | Uchiyama | 271/122 |
| 5,384,631 | A * | 1/1995 | Matsunami | 271/262 |
| 5,442,431 | A * | 8/1995 | Fujimoto et al. | 271/270 |
| 5,651,538 | A * | 7/1997 | Chung et al. | 271/258.03 |
| 6,585,252 | B1 * | 7/2003 | Russo et al. | 271/122 |
| 7,036,815 | B2 * | 5/2006 | Yamamoto | 271/125 |
| 7,048,271 | B2 * | 5/2006 | Sheng et al. | 271/121 |
| 7,537,213 | B2 * | 5/2009 | Chang et al. | 271/262 |
| 7,588,245 | B2 * | 9/2009 | Mandel et al. | 271/122 |
| 2007/0018383 | A1 * | 1/2007 | Ohara et al. | 271/262 |
| 2008/0073834 | A1 * | 3/2008 | Chang et al. | 271/262 |

FOREIGN PATENT DOCUMENTS

JP 06156850 A * 6/1994

* cited by examiner

*Primary Examiner* — Gerald McClain
(74) *Attorney, Agent, or Firm* — Kirton McConkie; Evan R. Witt

(57) ABSTRACT

An automatic document feeder includes a sheet input tray, a transfer channel, a sheet pick-up module, a retard roller, a thickness detecting module and a controlling unit. When the sheet pick-up module is driven, the documents placed on the sheet input tray are fed into the transfer channel. The thickness detecting module is used for detecting a thickness of the documents. The controlling unit is used for judging whether a multiple-feeding event occurs. In a case that the multiple-feeding event occurs, the sheet pick-up module is reversely rotated such that the documents are returned to the sheet input tray. When the sheet pick-up module is reversely rotated, the retard roller provides a lower frictional force, so that the documents are allowed to be returned to the sheet input tray.

12 Claims, 6 Drawing Sheets

AUTOMATIC DOCUMENT FEEDER WITH SHEET PICK-UP MODULE WITH SECOND ROTATION DIRECTION DELAYING TIME

FIELD OF THE INVENTION

The present invention relates to an automatic document feeder, and more particularly to an automatic document feeder having a sheet-returning function.

BACKGROUND OF THE INVENTION

In the early stage, a scanning apparatus is used to scan the image of a single document. After the image of the document has been scanned, the document should be removed from the scanning apparatus and then a next document could be placed on the scanning apparatus in order to be further scanned. Since the process of manually replacing the document is very troublesome, the conventional scanning apparatus is not feasible to scan a stack of documents. Recently, an automatic document feeder is usually integrated into the scanning apparatus. After a stack of documents to be scanned are placed on the sheet input tray of the automatic document feeder, the automatic document feeder will successively transport the documents to perform a scanning operation without the need of manually replacing the documents. This means of automatically feeding the documents is both time-saving and efficient. The automatic document feeder is also feasible to perform a duplex scanning operation.

Generally, the automatic document feeder has a sheet input tray for placing a stack of documents. The automatic document feeder also has a sheet pick-up module for successively feeding the stack of documents from the sheet input tray to the internal portion of the automatic document feeder in a sheet-feeding direction. For allowing only one document to be fed into the internal portion of the automatic document feeder at each feeding time, the sheet pick-up module has a sheet separation roller and a separation pad or retard roller. The separation pad or retard roller is disposed under the sheet separation roller. The sheet separation roller may provide a friction force to the document that is contacted with the separation pad (or retard roller). The frictional forces between the sheet pick-up module, the separation pad (or retard roller) and the documents should be elaborately controlled. Generally, the friction force between the sheet pick-up module and the document contacted with the sheet pick-up module is greater than the friction force between the documents. In addition, the friction force between the separation pad (or retard roller) and the document contacted with the separation pad (or retard roller) is also greater than the friction force between the documents. As a consequence, only one document is allowed to be fed into the internal portion of the automatic document feeder at each feeding time.

The conventional automatic document feeder, however, still has some drawbacks. For example, when a stack of documents are fed by the automatic document feeder, a double-feeding or multiple-feeding event usually occurs. Since the user fails to realize whether the documents have been completely scanned if the multiple-feeding event occurs, some missing pages are undesirably obtained. Moreover, due to the multiple-feeding event, the documents are possibly damaged, or even the automatic document feeder is damaged.

Moreover, in a case that the automatic document feeder is suffered from the multiple-feeding event, the documents are readily jammed in the internal portion of the automatic document feeder. Due to the friction force between the jammed documents and the separation pad (or retard roller), the jammed documents fail to be pulled out of the automatic document feeder in a sheet-returning direction, which is opposed to the sheet-feeding direction. For releasing the jammed documents, the user needs to open the upper cover of the automatic document feeder to uplift the sheet pick-up module, so that the sheet pick-up module is separated from the upper side of the document. As such, the sheet pick-up module is separated from the upper sides of the jammed documents and the friction force between the jammed documents and the separation pad (or retard roller) is eliminated. Meanwhile, the jammed documents could be effectively released.

Therefore, there is a need of providing an automatic document feeder for detecting the multiple-feeding event and returning the documents in order to obviate the drawbacks encountered from the prior art.

SUMMARY OF THE INVENTION

The present invention provides an automatic document feeder for automatically returning the documents when a multiple-feeding event occurs and feeding the documents again after the sheet-returning process is completed.

In accordance with an aspect of the present invention, there is provided an automatic document feeder for feeding plural documents. The automatic document feeder includes a sheet input tray, a transfer channel, a sheet pick-up module, a retard roller, a thickness detecting module and a controlling unit. The sheet input tray is used for placing the plural documents. The plural documents include a first document and a second document. The sheet pick-up module is used for feeding the plural documents that are placed on the sheet input tray into the transfer channel. The retard roller is arranged under the sheet pick-up module and contacted with the second document, so that a first friction force or a second friction force between the retard roller and the second document is generated. The second friction force is smaller than the first friction force. The thickness detecting module is disposed above the transfer channel for detecting a thickness of the plural documents, thereby generating a thickness-detecting signal. The controlling unit is in communication with the thickness detecting module and the sheet pick-up module for controlling a rotating direction of the sheet pick-up module. If the thickness of the plural documents is smaller than or equal to a thickness threshold value, the sheet pick-up module is controlled by the controlling unit to continuously rotate in a first rotating direction, and a document friction force between the first document and the second document is smaller than the first friction force, so that the first document is allowed to be fed into the transfer channel. If the thickness of the plural documents is greater than the thickness threshold value, the sheet pick-up module is controlled by the controlling unit to continuously rotate in a second rotating direction, and the second friction force is smaller than the document friction force, so that the plural documents are returned to the sheet input tray. Under control of the controlling unit, after the sheet pick-up module is rotated in the second rotating direction for a delaying time, the sheet pick-up module is rotated in the first rotating direction to feed the plural documents into the transfer channel.

In an embodiment, the retard roller further includes a retard roller inner wall, a helical spring and a rotating shaft. The helical spring includes a first spring segment and a second spring segment. The first spring segment is contacted with the retard roller inner wall. An inner diameter of the first spring segment is greater than that of the second spring segment. The rotating shaft is penetrated through the helical spring such that the helical spring is fixed on the rotating shaft.

In an embodiment, when the plural documents are transported from the sheet input tray to the transfer channel, the retard roller is rotated in the second rotating direction, and the first spring segment is rotated in the second rotating direction to be stretched, so that a gap between the first spring segment and the retard roller inner wall is gradually reduced to be fixed and the second spring segment is twisted with respect to the rotating shaft to generate a first damping torque corresponding to the first friction force. Whereas, when the plural documents are transported from the transfer channel to the sheet input tray, the retard roller is rotated in the first rotating direction, the second spring segment is fixed on the rotating shaft, and the gap between the stretched first spring segment and the retard roller inner wall is gradually increased as the retard roller is rotated, so that a second damping torque corresponding to the second friction force is generated. The first damping torque is greater than the second damping torque.

In an embodiment, the retard roller includes a first sleeve, a second sleeve, a helical spring, a one-way clutch and a rotating shaft. The first sleeve has a sleeve inner tube. The second sleeve is accommodated within the first sleeve, and has a sleeve outer tube. The sleeve outer tube is arranged at an end of the second sleeve and contacted with an end of the sleeve inner tube. The helical spring is accommodated within the first sleeve. A first end of the helical spring is sheathed around the sleeve outer tube to define a first spring segment. A second end of the helical spring is sheathed around the sleeve inner tube to define a second spring segment. The first spring segment has a first spring inner diameter. The second spring segment has a second spring inner diameter smaller than the first spring inner diameter. The one-way clutch is accommodated within the second sleeve for preventing the second sleeve from rotating in the first rotating direction. The rotating shaft is penetrated through the first sleeve, the second sleeve and the one-way clutch.

In an embodiment, when the plural documents are transported from the sheet input tray to the transfer channel, the first sleeve is rotated in the first rotating direction, and the second sleeve fails to be rotated in response to the one-way clutch, so that the first spring segment is fixed on the sleeve outer tube and the second spring segment is twisted with respect to the sleeve inner tube to generate a first damping torque. Whereas, when the plural documents are transported from the transfer channel to the sheet input tray, the first sleeve is rotated in the second rotating direction, the first spring segment is fixed on the sleeve outer tube, and the second spring segment is fixed on the sleeve inner tube, so that the second sleeve is rotated with the first sleeve and the one-way clutch is rotated with respect to the rotating shaft to generate a second damping torque, wherein the first damping torque is greater than the second damping torque.

In an embodiment, a tube diameter of the sleeve inner tube is smaller than that of the sleeve outer tube, so that the interference between the first spring segment and the sleeve outer tube is greater than the interference between the second spring segment and the sleeve inner tube.

In an embodiment, the automatic document feeder further includes a document sensor, which is arranged at a first side of the thickness detecting module for detecting a transmitting status of the plural documents.

In an embodiment, the document sensor is arranged between the sheet pick-up module and the thickness detecting module. After the plural documents have been departed from the document sensor for the delaying time, the controlling unit controls the sheet pick-up module to rotate in the first rotating direction, so that the plural documents are fed into the transfer channel.

In an embodiment, the document sensor is a swinging arm contact sensor.

In an embodiment, the sheet pick-up module includes a sheet pick-up roller and a sheet separation roller. The sheet pick-up roller is synchronously rotated with the sheet separation roller. The sheet pick-up roller and the sheet separation roller are rotated in the same rotating direction.

In an embodiment, when the sheet pick-up module is rotated in the second rotating direction, the sheet pick-up module is swung such that the sheet pick-up roller is not contacted with the plural documents.

In an embodiment, the delaying time is a time interval when the sheet separation roller is rotated for a specified number of turns.

In an embodiment, the thickness detecting module further includes a detecting arm and an optical displacement sensing element. The detecting arm is disposed above the transfer channel. When the plural documents are transported across the detecting arm, the plural documents are sustained against the detecting arm, so that the detecting arm is moved. The optical displacement sensing element is arranged beside the detecting arm for detecting a displacement amount of the detecting arm, thereby acquiring the thickness of the plural documents.

In an embodiment, the automatic document feeder further includes a transfer roller, a sheet ejecting tray and a sheet ejecting roller. The transfer roller is disposed in the transfer channel for transporting the plural documents through the transfer channel. The sheet ejecting tray is arranged under the sheet input tray for supporting the plural documents that are ejected from the transfer channel. The sheet ejecting roller is used for transporting the plural documents to the sheet ejecting tray.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
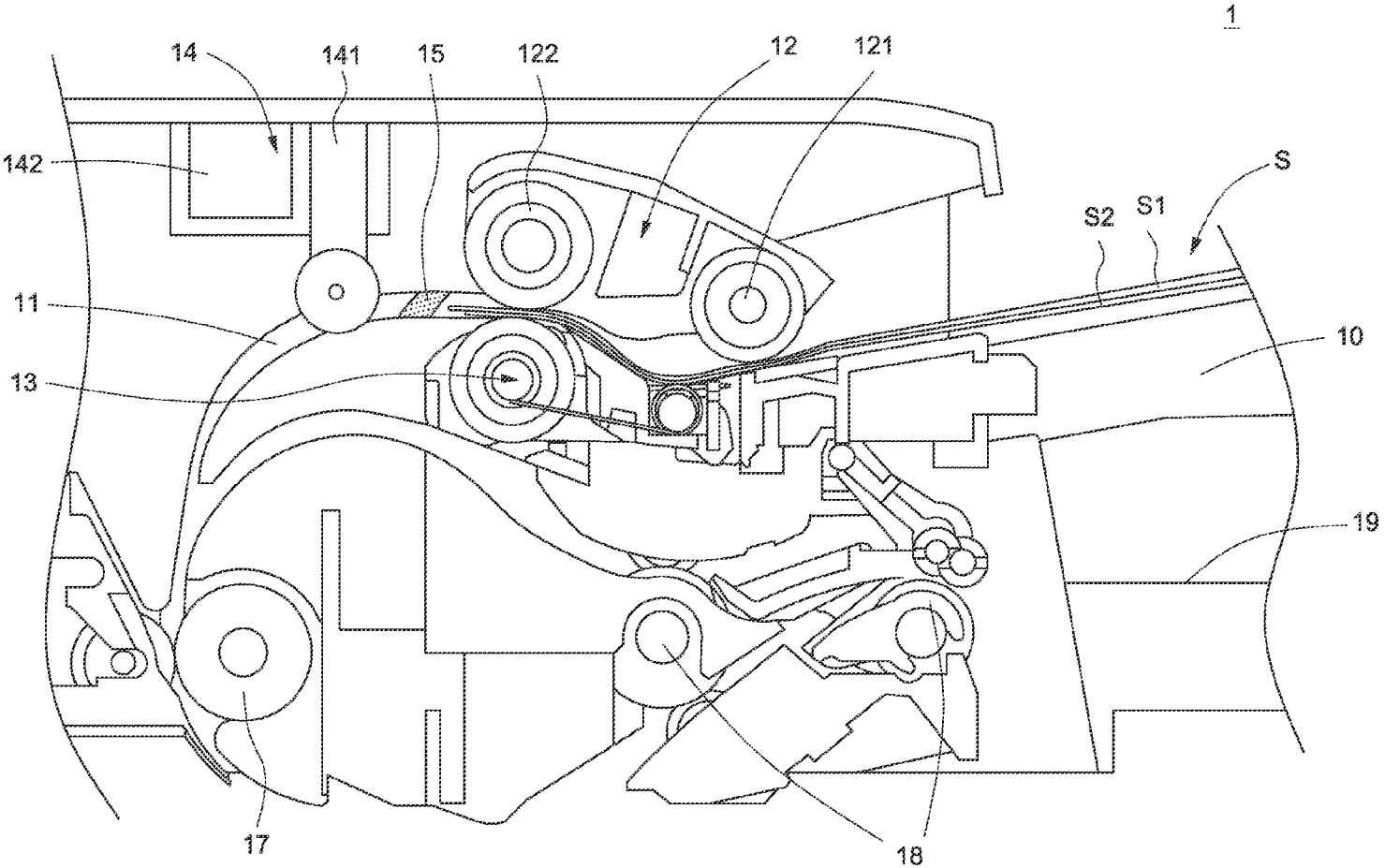
FIG. 1 is a schematic side view illustrating an automatic document feeder according to an embodiment of the present invention.

FIG. 1 is a schematic side view illustrating an automatic document feeder according to an embodiment of the present invention. As shown in FIG. 1, the automatic document feeder 1 comprises a sheet input tray 10, a transfer channel 11, a sheet pick-up module 12, a retard roller 13, a thickness detecting module 14, a document sensor 15, a controlling unit 16 (see FIG. 3), a transfer roller 17, a sheet ejecting roller assembly 18 and a sheet ejecting tray 19. Plural documents S to be scanned are placed on the sheet input tray 10. In this embodiment, the documents S include a first document S1 and a second document S2. The sheet pick-up module 12 is used for successively feeding the documents S that are placed on the sheet input tray 10 into the transfer channel 11. The sheet pick-up module 12 comprises a sheet pick-up roller 121 and a sheet separation roller 122. Upon rotation of the sheet separation roller 122, the sheet pick-up roller 121 is synchronously rotated. The sheet pick-up roller 121 and the sheet separation roller 122 are rotated in the same direction. The sheet pick-up module 12 is driven by the motive power of a driving motor (not shown). The retard roller 13 is disposed under the sheet pick-up module 12. In response to a first damping torque T1, the retard roller 13 generates a first frictional force F1 (see FIG. 3). In response to a second damping torque T2, the retard roller 13 generates a second frictional force F2 (see FIG. 4). The first damping torque T1 is greater than the second damping torque T2. In addition, the first damping torque T1 and the second damping torque T2 have opposite directions.

The thickness detecting module 14 is disposed above the transfer channel 11 for detecting the thickness of the plural documents S, thereby generating a thickness-detecting signal. In this embodiment, the thickness detecting module 14 comprises a detecting arm 141 and an optical displacement sensing element 142. The detecting arm 141 is disposed above the transfer channel 11. When the plural documents S are transported across the detecting arm 141, the plural documents S are sustained against the detecting arm 141, and thus the detecting arm 141 is moved. The optical displacement sensing element 142 is arranged beside the detecting arm 141 for detecting the displacement amount of the detecting arm 141, thereby acquiring the thickness of the plural documents S. A first image of the detecting arm 141 before the detecting arm 141 and a second image of the detecting arm 141 after the detecting arm 141 are sequentially acquired by the optical displacement sensing element 142. By comparing the second image with the first image, the displacement amount of the detecting arm 141 is calculated and thus the thickness of the plural documents S is acquired. In this embodiment, the sensing component of the thickness detecting module 14 for sensing the detecting arm 141 is illustrated by referring to the optical displacement sensing element. Nevertheless, a photoelectric sensor, a piezoelectric sensor, a capacitive sensor or any other sensor is also suitable for sensing the detecting arm 141.

The document sensor 15 is arranged at a first side of the thickness detecting module 14 for detecting the plural documents S. In this embodiment, the document sensor 15 is arranged between the sheet pick-up module 12 and the thickness detecting module 14. An example of the document sensor 15 is a swinging arm contact sensor. Alternatively, the document sensor 15 is another type sensor such as a light sensor. The controlling unit 16 is in communication with the thickness detecting module 14, the document sensor 15 and the sheet pick-up module 12. According to the thickness-detecting signal, the controlling unit 16 will control the rotating direction of the sheet pick-up module 12. The transfer roller 17 is arranged in the transfer channel 11 for transporting the plural documents S through the transfer channel 11. The sheet ejecting tray 19 is disposed under the sheet input tray 10 for supporting the plural documents S that are ejected out of the automatic document feeder 1. The sheet ejecting roller assembly 18 is used for ejecting the plural documents S to the sheet ejecting tray 19.

Figure 2:
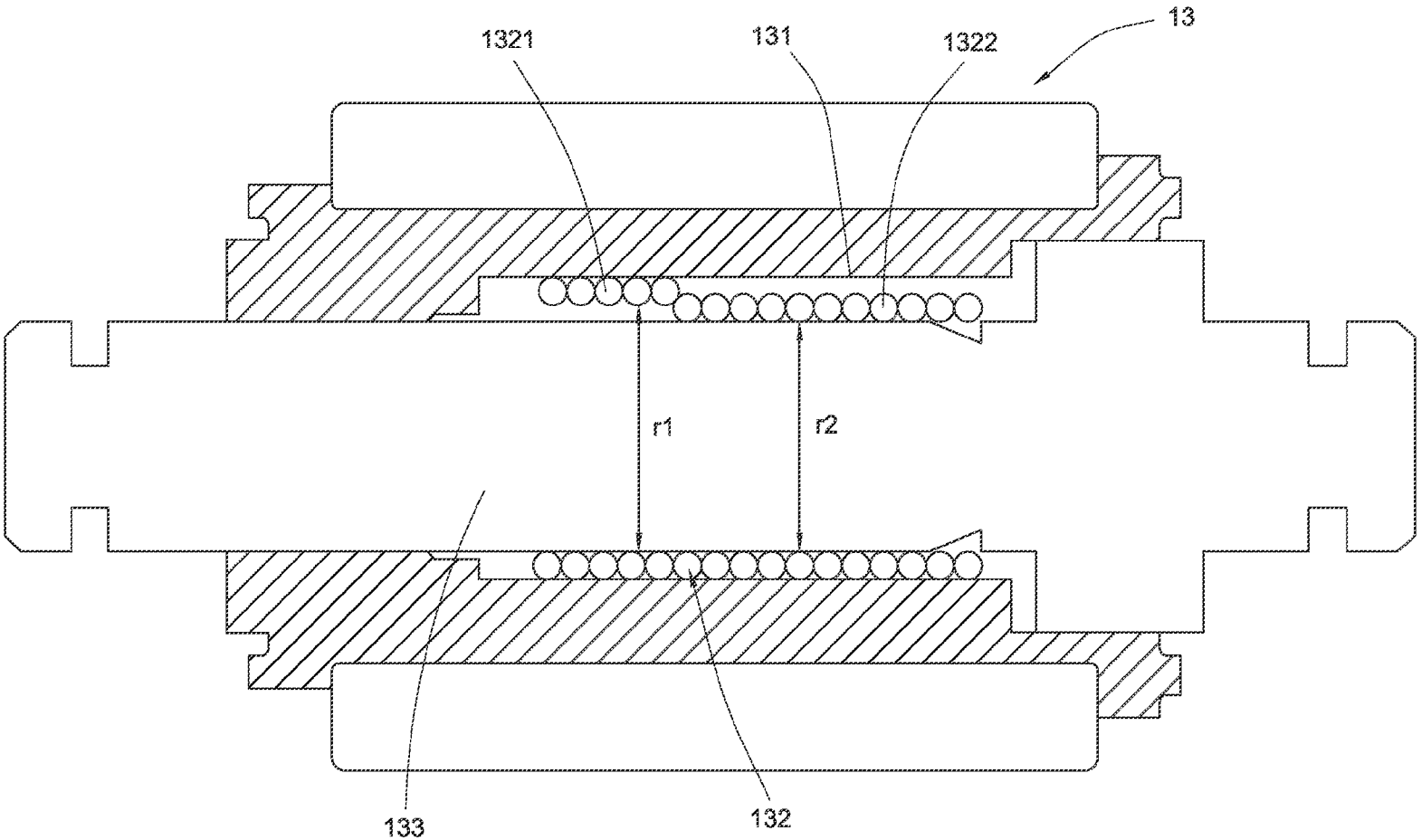
FIG. 2 is a schematic cross-sectional view illustrating a retard roller of the automatic document feeder according to an embodiment of the present invention.

Hereinafter, the configurations of the retard roller 13 will be illustrated with reference to FIG. 2. FIG. 2 is a schematic cross-sectional view illustrating a retard roller of the automatic document feeder according to an embodiment of the present invention. As shown in FIG. 2, the retard roller 13 comprises a retard roller inner wall 131, a helical spring 132 and a rotating shaft 133. The helical spring 132 comprises a first spring segment 1321 and a second spring segment 1322. The first spring segment 1321 is contacted with the retard roller inner wall 131. The inner diameter r1 of the first spring segment 1321 is greater than the inner diameter r2 of the second spring segment 1322. The rotating shaft 133 is penetrated through the helical spring 132, so that the helical spring 132 is fixed on the rotating shaft 133.

Figure 3:
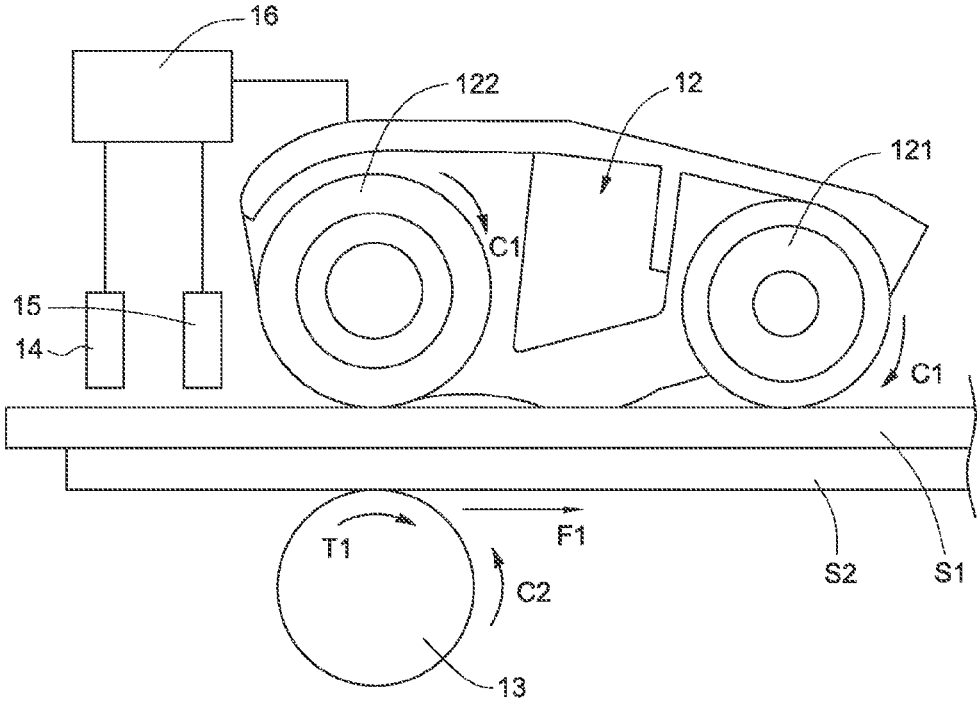
FIG. 3 is a schematic side view illustrating a process for feeding the documents by the sheet pick-up module and the retard roller of the automatic document feeder according to an embodiment of the present invention.

Hereinafter, the principle of generating the damping torque will be illustrated with reference to FIGS. 2 and 3. FIG. 3 is a schematic side view illustrating a process for feeding the documents by the sheet pick-up module and the retard roller of the automatic document feeder according to an embodiment of the present invention. For feeding the plural documents S by the automatic document feeder 1, the sheet pick-up roller 121 and the sheet separation roller 122 are rotated in a first rotating direction C1, but the retard roller 13 is rotated in a second rotating direction C2. In this embodiment, the first rotating direction C1 is a clockwise direction, and the second rotating direction C2 is an anti-clockwise direction. When the retard roller 13 is rotated in the second rotating direction C2, the first spring segment 1321 is twisted in the second rotating direction C2. Due to the twisting direction of the helical spring 132, the first spring segment 1321 is stretched. The gap between the first spring segment 1321 and the retard roller inner wall 131 is gradually decreased and then fixed. Meanwhile, the second spring segment 1322 is twisted with respect to the rotating shaft 133 to the rotating shaft 13 to generate a first damping torque T1 corresponding to a first frictional force F1. The first frictional force F1 is in direct proportion to the first damping torque T1.

Figure 4:
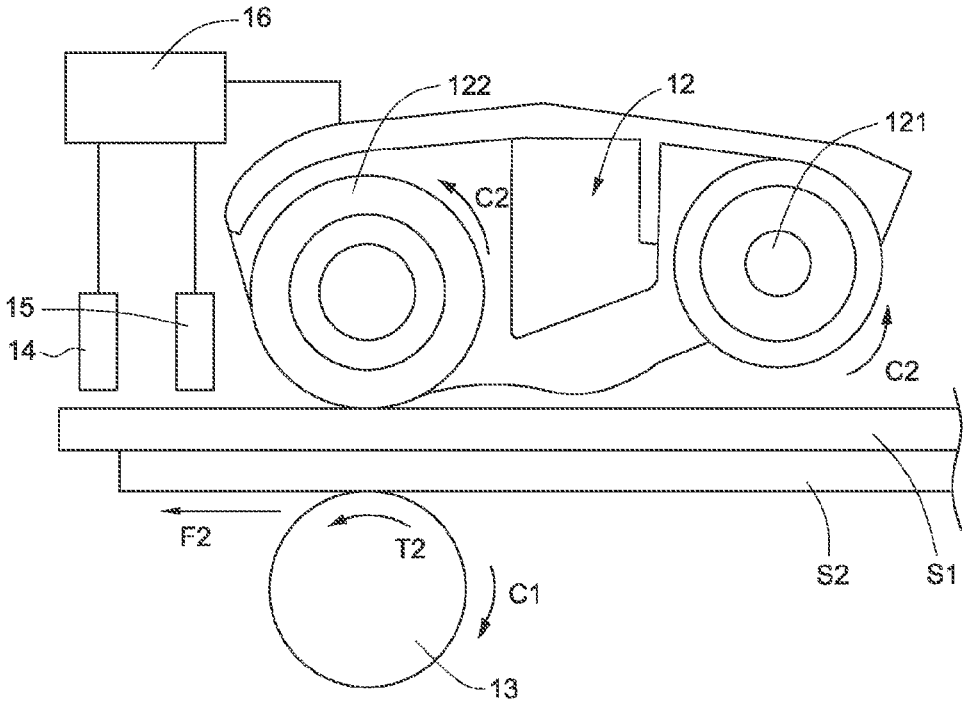
FIG. 4 is a schematic side view illustrating a process for returning the documents by the sheet pick-up module and the retard roller of the automatic document feeder according to an embodiment of the present invention.

FIG. 4 is a schematic side view illustrating a process for returning the documents by the sheet pick-up module and the retard roller of the automatic document feeder according to an embodiment of the present invention. Please refer to FIGS. 2 and 4. When the retard roller 13 is rotated in the first rotating direction C1, the second spring segment 1322 is fixed (tightened) on the rotating shaft 133 due to the twisting direction of the helical spring 132. Upon rotation of the retard roller 13, the gap between the stretched first spring segment 1321 and the retard roller inner wall 131 is gradually increased. As such, a second damping torque T2 corresponding to the second frictional force F2 is generated. The first damping torque T1 is greater than the second damping torque T2. In addition, the second frictional force F2 is in direct proportion to the second damping torque T2. When the retard roller 13 is rotated in the first rotating direction C1, the stretched first spring segment 1321 is restored to the original state upon rotation of the retard roller 13. As such, the gap between the first spring segment 1321 and the retard roller inner wall 131 is increased, and the interference between the first spring segment 1321 and the retard roller inner wall 131 is reduced. In this situation, the second damping torque T2 is very low.

Especially, the inner diameter r1 of the first spring segment 1321 and the dimension of the retard roller inner wall 131 are elaborately computed, so that specified interference is generated between the first spring segment 1321 and the retard roller inner wall 131. Similarly, the inner diameter r2 of the second spring segment 1322 and the dimension of the rotating shaft 133 are also elaborately computed, so that the first damping torque T1 is greater than the second damping torque T2 and the second damping torque T2 is very low.

Figure 7:
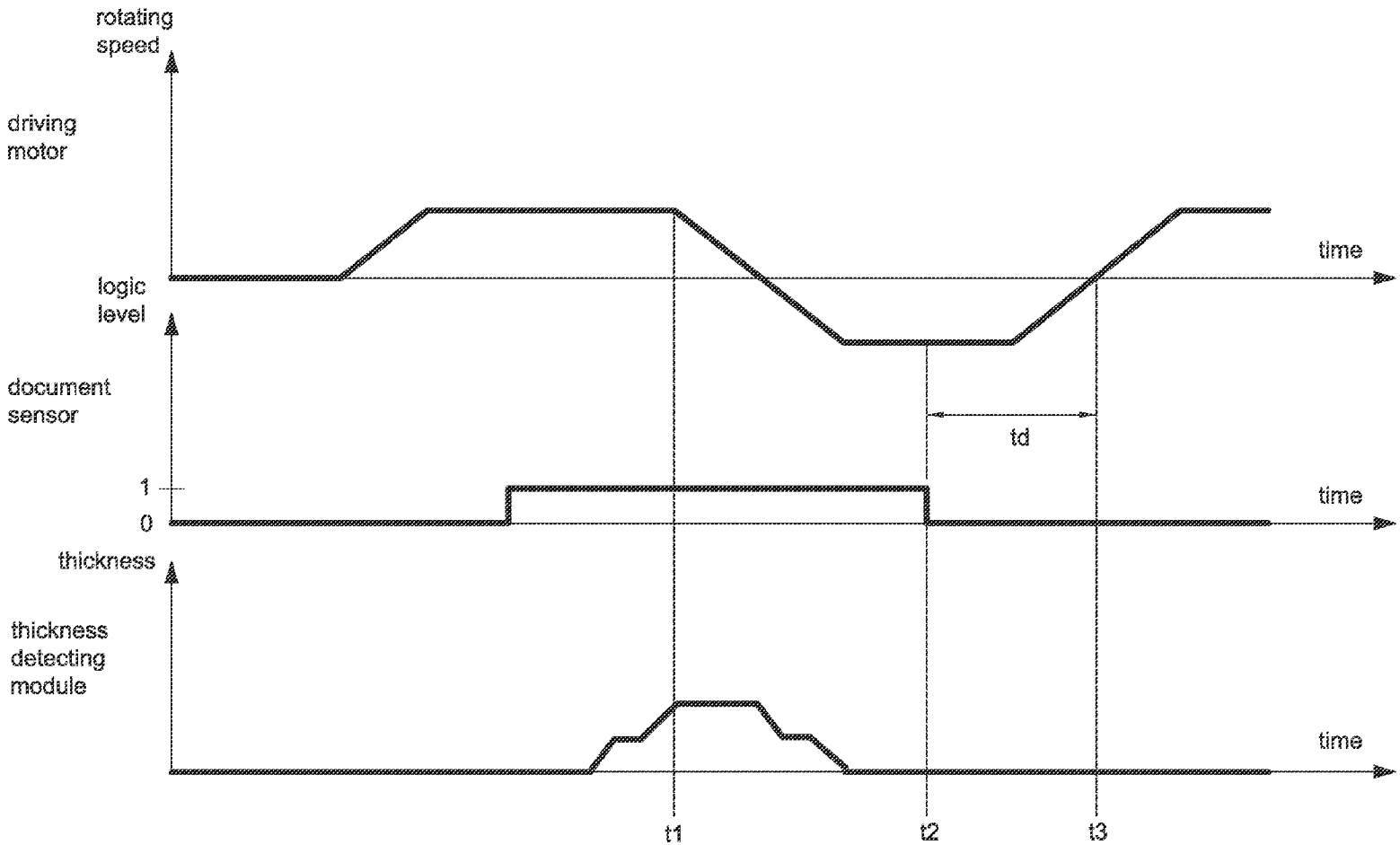
FIG. 7 is a schematic timing diagram illustrating the operations of the automatic document feeder according to an embodiment of the present invention.

Hereinafter, the operations of the automatic document feeder 1 of the present invention will be illustrated with reference to FIGS. 1, 3 and 7. FIG. 7 is a schematic timing diagram illustrating the operations of the automatic document feeder according to an embodiment of the present invention. From top to bottom, the rotating speed of the driving motor, the transmitting status of the documents S detected by the document sensor 15, and thickness detected by the thickness detecting module 14 are respectively shown in FIG. 7. In a case that the automatic document feeder 1 is in a standby status, the rotating speed of the driving motor is zero. Since the documents S are not detected by the document sensor 15, the document sensor 15 is in a low logic level state (i.e. logic value=0). In addition, the thickness of the documents S detected by the thickness detecting module 14 is zero. For feeding the plural documents S on the sheet input tray 10 into the transfer channel 11 by the automatic document feeder 1, the sheet pick-up roller 121 and the sheet separation roller 122 of the sheet pick-up module 12 are controlled by the controlling unit 16 to rotate in the first rotating direction C1. As such, the first document S1 is contacted with the sheet pick-up roller 121 and the sheet separation roller 122 to be transported. Since the first document S1 and the second document S2 are contacted with each other, a document frictional force Fs is generated between the first document S1 and the second document S2. Since the retard roller 13 under the sheet pick-up module 12 and the second document S2 are contacted with each other, a first frictional force F1 is generated between the retard roller 13 and the second document S2. In a case that the first frictional force F1 is greater than the document frictional force Fs, the first document S1 is allowed to be fed into the transfer channel 11. On the other hand, if the first frictional force F1 is smaller than or equal to the document frictional force Fs, the first document S1 and the second document S2 are both fed into the transfer channel 11. Meanwhile, a double-feeding event occurs. The occurrence of the double-feeding event is shown in FIG. 1 for example.

When the plural documents S are transported across the sheet pick-up module 12, the plural documents S are detected by the document sensor 15. As such, the document sensor 15 is triggered, and the transmitting status of the documents S detected by the document sensor 15 is switched from the low logic level state to a high logic level state (i.e. logic value=1). Once the plural documents S are transported across the thickness detecting module 14, the thickness of the plural documents S is detected. As shown in FIG. 7, the document sensor 15 is triggered to have a logic value 1, and the thickness detected by the thickness detecting module 14 is gradually increased. The plural documents S are continuously transported. Once another thickness is detected by the thickness detecting module 14 and the thickness of the plural documents S is greater than the thickness threshold value (e.g. a thickness of a single document), it is meant that the double-feeding event occurs. Meanwhile, the thickness detecting module 14 issues a thickness-detecting signal to the controlling unit 16. According to the thickness-detecting signal, the controlling unit 16 controls the sheet pick-up module 12 to perform a sheet-returning operation at the time spot t1 (see FIG. 7). In this situation, the relation between the sheet pick-up module 12 and the plural documents S is shown in FIG. 3.

Please refer to FIGS. 1, 4 and 7 again. During the sheet pick-up module 12 is controlled by the controlling unit 16 to perform the sheet-returning operation, the sheet pick-up module 12 is swung under control of the controlling unit 16, so that the sheet separation roller 122 is contacted with the first document S1 but the sheet pick-up roller 121 is no longer contacted with the first document S1. Since the rotating speed of the sheet pick-up roller 121 is slower than that of the sheet separation roller 122, if the sheet pick-up roller 121 and the sheet separation roller 122 are both contacted with the first document S1 during the sheet-returning process, the first document S1 will be bent or even damaged. Once the sheet separation roller 122 is controlled by the controlling unit 16 to rotate in the second rotating direction C2, the retard roller 13 is rotated in the first rotating direction C1 in response to movement of the first document S1 and the second document S2. As such, the retard roller 13 generates a second damping torque T2, which is near to zero. In other words, the second frictional force F2 corresponding to the second damping torque T2 is also very low. Since the force applied on the first document S1 and the second document S2 is greater than the second frictional force F2, the second frictional force F2 will be smoothly moved toward the sheet input tray 10. Moreover, since the second frictional force F2 is smaller than the document frictional force Fs between the first document S1 and the second document S2, the first document S1 and the second document S2 are simultaneously transported, wherein the front end of the first document S1 is protruded out of the front end of the second document S2.

As shown in FIG. 7, as the rotating speed of the driving motor is gradually decreased, it is meant that the sheet separation roller 122 stops rotating in the first rotating direction C1. When the rotating speed of the driving motor is negative, it is meant that the sheet separation roller 122 is rotated in the second rotating direction C2. That is, the sheet separation roller 122 is reversely rotated. Since the document sensor 15 still has the logic value 1, the plural documents S to be moved toward the sheet input tray 10 have not been departed from the document sensor 15. Since the thickness detected by the thickness detecting module 14 is gradually decreased, it is meant that the plural documents S are gradually departed from the thickness detecting module 14 and moved toward the sheet input tray 10.

Figure 5:
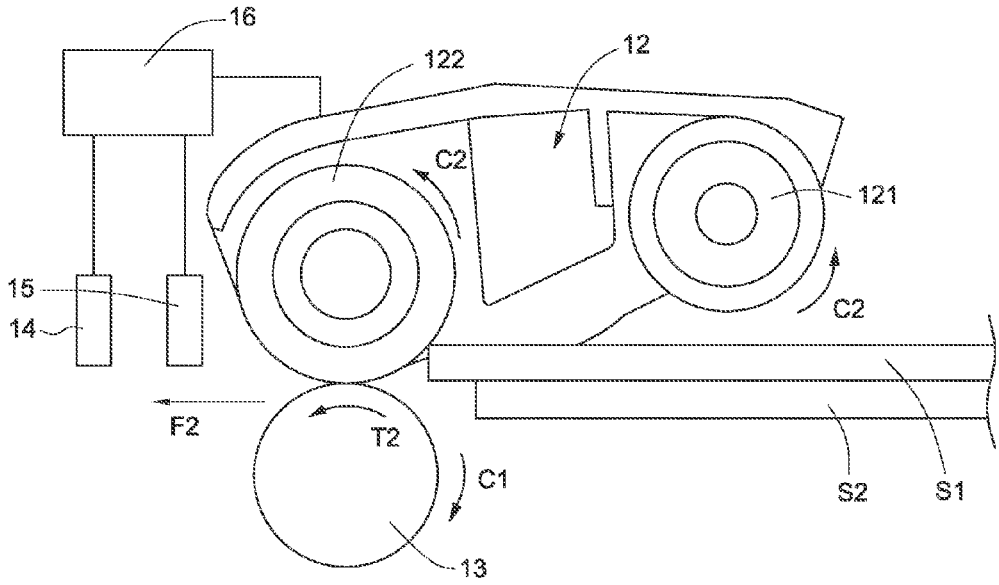
FIG. 5 is a schematic side view illustrating that the documents are completely returned to the sheet input tray by the sheet pick-up module and the retard roller of the automatic document feeder according to an embodiment of the present invention.

Please refer to FIG. 7 again. At the time spot t2, the logic value of the document sensor 15 is switched from 1 to 0 because the plural documents S to be moved toward the sheet input tray 10 have been departed from the document sensor 15. At time spot t2, the controlling unit 16 starts to count a delaying time td, thereby awaiting the plural documents S to return to the sheet input tray 10 and assuring that the plural documents S are completely ejected out of the transfer channel 11. In addition, the front end of the first document S1 is still arranged under the sheet pick-up module 12. In this situation, the relation between the sheet pick-up module 12 and the plural documents S is shown in FIG. 5.

Figure 6:
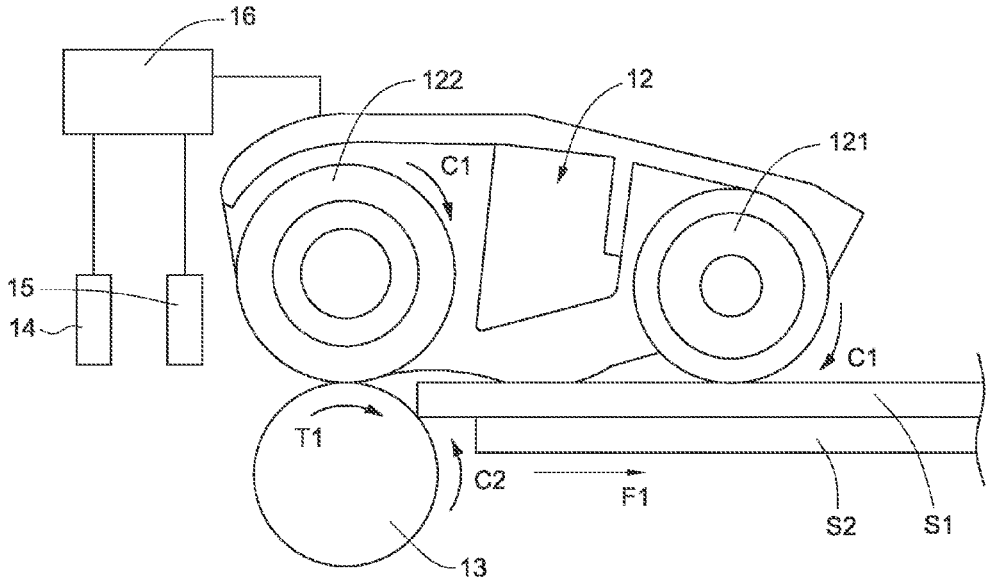
FIG. 6 is a schematic side view illustrating a process for returning the documents again by the sheet pick-up module and the retard roller of the automatic document feeder according to an embodiment of the present invention.

After the delaying time td (i.e. at the time spot t3), the sheet pick-up module 12 is swung under control of the controlling unit 16, so that the sheet pick-up roller 121 and the sheet separation roller 122 are both contacted with the first document S1. In addition, the sheet pick-up roller 121 and the sheet separation roller 122 are rotated in the first rotating direction C1 under control of the controlling unit 16. As such, the first document S1 is fed into the transfer channel 11 again. In this situation, the relation between the sheet pick-up module 12 and the plural documents S is shown in FIG. 6.

In this embodiment, the delaying time td is a time interval when the sheet separation roller 122 is rotated for a specified number of turns. When the sheet separation roller 122 is rotated for the specified number of turns, the plural documents S could be at least transmitted from the document sensor 15 to the region under the sheet pick-up module 12.

In some embodiments, the document sensor is not included in the automatic document feeder of the present invention. Except for the setting of the delaying time, the operating principles are similar to those described above. For example, in a case that the document sensor is not included in the automatic document feeder, the controlling unit could start to count the delaying time when the sheet pick-up module is rotated in the second rotating direction. After the delaying time, under control of the controlling unit, the sheet pick-up module is rotated in the first rotating direction to feed the plural documents into the transfer channel. The delaying time is also equal to a time interval when the sheet separation roller is rotated for a specified number of turns. When the sheet separation roller is rotated for the specified number of turns, the plural documents could be at least transmitted from the document sensor to the region under the sheet pick-up module.

Figure 8:
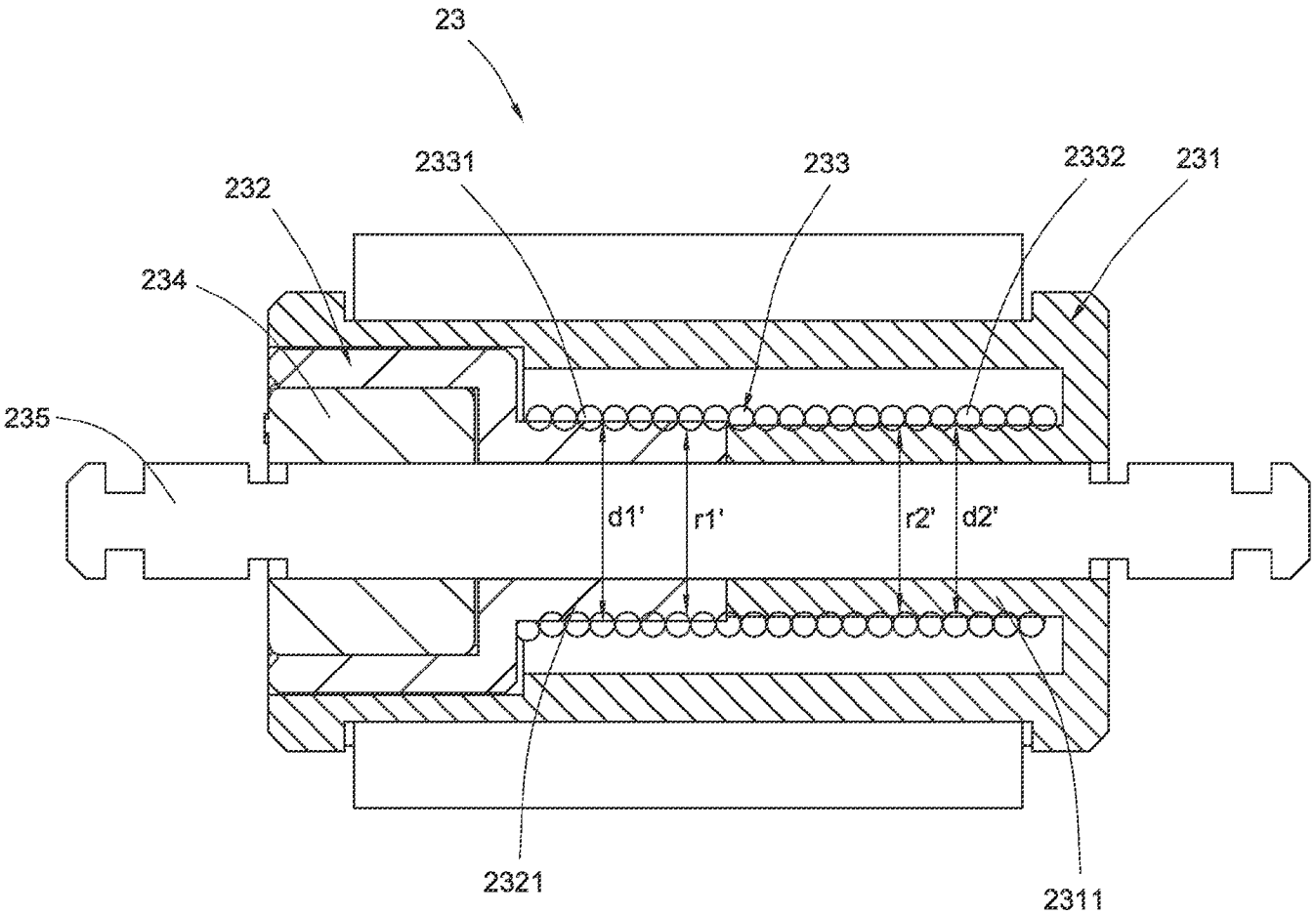
FIG. 8 is a schematic cross-sectional view illustrating a retard roller of the automatic document feeder according to another embodiment of the present invention.

FIG. 8 is a schematic cross-sectional view illustrating a retard roller of the automatic document feeder according to another embodiment of the present invention. Except for the retard roller, the configurations of the other components included in the automatic document feeder of this embodiment are similar to those illustrated in the first embodiment, and are not redundantly described herein. In this embodiment, the retard roller 23 comprises a first sleeve 231, a second sleeve 232, a helical spring 233, a one-way clutch 234 and a rotating shaft 235. The first sleeve 231 has a sleeve inner tube 2311. The second sleeve 232 is accommodated within the first sleeve 231. The second sleeve 232 has a sleeve outer tube 2321. The sleeve outer tube 2321 is arranged at an end of the second sleeve 232, and contacted with an end of the sleeve inner tube 2311. The tube diameter d2' of the sleeve inner tube 2311 is smaller than the tube diameter d1' of the sleeve outer tube 2321.

The helical spring 233 is accommodated within the first sleeve 231. An end of the helical spring 233 is sheathed around the sleeve outer tube 2321 to define a first spring segment 2331. The other end of the helical spring 233 is sheathed around the sleeve inner tube 2311 to define a second spring segment 2332. The first spring segment 2331 has a first spring inner diameter r1'. The second spring segment 2332 has a second spring inner diameter r2', which is smaller than the first spring inner diameter r1'. As such, the interference between the first spring segment 2331 and the sleeve outer tube 2321 is greater than the interference between the second spring segment 2332 and the sleeve inner tube 2311. The one-way clutch 234 is accommodated within the second sleeve 232 for preventing the second sleeve 232 from rotating in the first rotating direction. That is, due to the one-way clutch 234, the second sleeve 232 is allowed to be rotated in the second rotating direction. The rotating shaft 235 is penetrated through the first sleeve 231, the second sleeve 232 and the one-way clutch 234.

In a case that the retard roller is rotated in the first rotating direction, the first sleeve 231 is also rotated in the first rotating direction. Due to the one-way clutch 234, the second sleeve 232 fails to be rotated, so that the first spring segment 2331 is fixed on the sleeve outer tube 2321. In addition, the second spring segment 2332 is twisted with respect to the sleeve inner tube 2311 to generate a first damping torque. In a case that the retard roller is rotated in the second rotating direction, the first sleeve 231 is also rotated in the second rotating direction. The first spring segment 2331 is fixed on the sleeve outer tube 2321, and the second spring segment 2332 is fixed on the sleeve inner tube 2311. The second sleeve 232 is rotated with the first sleeve 231. In addition, the one-way clutch 234 is rotated with respect to the rotating shaft 235, so that a second damping torque is generated. The first damping torque is greater than the second damping torque.

Since the one-way clutch 234 is smoothly rotated with respect to the rotating shaft 235, the interference between the one-way clutch 234 and the rotating shaft 235 is nearly zero. In other words, the second damping torque is nearly zero, and the second frictional force corresponding to the second damping torque is nearly zero. In this situation, the plural documents could be moved from the transfer channel to the sheet input tray without obstruction, and the plural documents could be easily removed.

From the above description, the automatic document feeder is capable of returning the documents without the need of opening the upper cover, because the retard roller can provides two damping torques with different directions and different magnitudes. After the documents are completely returned, the documents could be automatically fed into the transfer channel again. Since the documents are automatically fed into the transfer channel again after the sheet-returning operation is completed, the user does not need to monitor whether the double-feeding or multiple-feeding event occurs during the automatic document feeder is used for feeding the documents. The automatic document feeder can be automatically operated while assuring successful scanning operations of the documents.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An automatic document feeder for feeding plural documents, said automatic document feeder comprising:

a sheet input tray for placing said plural documents, wherein said plural documents comprise a first document and a second document;

a transfer channel;

a sheet pick-up module for feeding said plural documents that are placed on said sheet input tray into said transfer channel;

a retard roller arranged under said sheet pick-up module and contacted with said second document, so that a first frictional force or a second frictional force between said retard roller and said second document is generated, wherein said second frictional force is smaller than said first frictional force, wherein said retard roller comprises:

a first sleeve having a sleeve inner tube;

a second sleeve accommodated within said first sleeve, and having a sleeve outer tube, wherein said sleeve outer tube is arranged at an end of said second sleeve and contacted with an end of said sleeve inner tube;

a helical spring accommodated within said first sleeve, a first end of said helical spring is sheathed around said sleeve outer tube to define a first spring segment, a second end of the helical spring is sheathed around said sleeve inner tube to define a second spring segment, said first spring segment has a first spring inner diameter, and said second spring segment has a second spring inner diameter smaller than said first spring inner diameter;

a one-way clutch accommodated within said second sleeve for preventing said second sleeve from rotating in said first rotating direction; and a rotating shaft penetrated through said first sleeve, said second sleeve and said one-way clutch;

a thickness detecting module disposed above said transfer channel for detecting a thickness of said plural documents, thereby generating a thickness-detecting signal; and a controlling unit in communication with said thickness detecting module and said sheet pick-up module for controlling a rotating direction of said sheet pick-up module, wherein if said thickness of said plural documents is smaller than or equal to a thickness threshold value, said sheet pick-up module is controlled by said controlling unit to continuously rotate in a first rotating direction, and a document frictional force between said first document and said second document is smaller than said first frictional force, so that said first document is allowed to be fed into said transfer channel, wherein if said thickness of said plural documents is greater than said thickness threshold value, said sheet pick-up module is controlled by said controlling unit to continuously rotate in a second rotating direction, and said second frictional force is smaller than said document frictional force, so that said plural documents are returned to said sheet input tray, wherein under control of said controlling unit, after said sheet pick-up module is rotated in said second rotating direction for a delaying time, said sheet pick-up module is rotated in said first rotating direction to feed said plural documents into said transfer channel.

2. The automatic document feeder according to claim 1 wherein when said plural documents are transported from said sheet input tray to said transfer channel, said first sleeve is rotated in said first rotating direction, and said second sleeve fails to be rotated in response to said one-way clutch, so that said first spring segment is fixed on said sleeve outer tube and said second spring segment is twisted with respect to said sleeve inner tube to generate a first damping torque, wherein when said plural documents are transported from said transfer channel to said sheet input tray, said first sleeve is rotated in said second rotating direction, said first spring segment is fixed on said sleeve outer tube, and said second spring segment is fixed on said sleeve inner tube, so that said second sleeve is rotated with said first sleeve and said one-way clutch is rotated with respect to said rotating shaft to generate a second damping torque, wherein said first damping torque is greater than said second damping torque.

3. The automatic document feeder according to claim 2 wherein the first damping torque and the second damping torque have opposite directions.

4. The automatic document feeder according to claim 2 wherein the retard roller generates the first frictional force in response to the first damping torque and wherein the retard roller generates the second frictional force in response to the second damping torque.

5. The automatic document feeder according to claim 1 wherein said thickness detecting module further comprises:

a detecting arm disposed above said transfer channel, wherein when said plural documents are transported across said detecting arm, said plural documents are sustained against said detecting arm, so that said detecting arm is moved; and an optical displacement sensing element arranged beside said detecting arm for detecting a displacement amount of said detecting arm, thereby acquiring said thickness of said plural documents.

6. The automatic document feeder according to claim 1 wherein a tube diameter of said sleeve inner tube is smaller than that of said sleeve outer tube, so that the interference between said first spring segment and the sleeve outer tube is greater than the interference between said second spring segment and said sleeve inner tube.

7. The automatic document feeder according to claim 1 further comprising a document sensor, which is arranged at a first side of said thickness detecting module for detecting a transmitting status of said plural documents.

8. The automatic document feeder according to claim 7 wherein said document sensor is arranged between said sheet pick-up module and said thickness detecting module, wherein after said plural documents have been departed from the document sensor for said delaying time, said controlling unit controls said sheet pick-up module to rotate in said first rotating direction, so that said plural documents are fed into said transfer channel.

9. The automatic document feeder according to claim 1 wherein said sheet pick-up module comprises a sheet pick-up roller and a sheet separation roller, said sheet pick-up roller is synchronously rotated with said sheet separation roller, and said sheet pick-up roller and said sheet separation roller are rotated in the same rotating direction.

10. The automatic document feeder according to claim 9 wherein said delaying time is a time interval when said sheet separation roller is rotated for a specified number of turns.

11. The automatic document feeder according to claim 9 wherein when said sheet pick-up module is rotated in said second rotating direction, said sheet pick-up module is swung such that said sheet pick-up roller is not contacted with said plural documents.

12. The automatic document feeder according to claim 1 further comprising:

a transfer roller disposed in said transfer channel for transporting said plural documents through said transfer channel;

a sheet ejecting tray arranged under said sheet input tray for supporting said plural documents that are ejected from said transfer channel; and a sheet ejecting roller for transporting said plural documents to said sheet ejecting tray.

* * * * *